US011302303B2

(12) United States Patent
Li et al.

(10) Patent No.: US 11,302,303 B2
(45) Date of Patent: Apr. 12, 2022

(54) METHOD AND DEVICE FOR TRAINING AN ACOUSTIC MODEL

(71) Applicant: Baidu Online Network Technology (Beijing) Co., Ltd, Beijing (CN)

(72) Inventors: Yunfeng Li, Beijing (CN); Qingchang Hao, Beijing (CN); Yutao Gai, Beijing (CN); Chenxi Sun, Beijing (CN); Zhiping Zhou, Beijing (CN)

(73) Assignee: Baidu Online Network Technology (Beijing) Co., Ltd., Beijing (CN)

( * ) Notice: Subject to any disclaimer, the term of this patent is extended or adjusted under 35 U.S.C. 154(b) by 77 days.

(21) Appl. No.: 16/570,371

(22) Filed: Sep. 13, 2019

(65) Prior Publication Data

US 2020/0193964 A1 Jun. 18, 2020

(30) Foreign Application Priority Data

Dec. 18, 2018 (CN) ..... 201811552516.1

(51) Int. Cl.
*G10L 13/047* (2013.01)
*G10L 25/03* (2013.01)

(52) U.S. Cl.
CPC ..... *G10L 13/047* (2013.01); *G10L 25/03* (2013.01)

(58) Field of Classification Search
None
See application file for complete search history.

(56) References Cited

U.S. PATENT DOCUMENTS

| | | | | |
|---|---|---|---|---|
| 9,202,464 | B1 * | 12/2015 | Senior | G06N 3/02 |
| 9,466,292 | B1 * | 10/2016 | Lei | G10L 15/16 |
| 2006/0122834 | A1 | 6/2006 | Bennett | |
| 2015/0019214 | A1 * | 1/2015 | Wang | G06N 3/02 704/232 |
| 2015/0200867 | A1 | 7/2015 | Dutta et al. | |
| 2017/0178664 | A1 * | 6/2017 | Wingate | G10L 25/30 |
| 2018/0314935 | A1 | 11/2018 | Lewis et al. | |
| 2018/0357543 | A1 | 12/2018 | Brown et al. | |

FOREIGN PATENT DOCUMENTS

| | | | |
|---|---|---|---|
| CN | 107025205 | A | 8/2017 |
| CN | 107885762 | A | 4/2018 |
| CN | 108352127 | A | 7/2018 |
| CN | 108737268 | A | 11/2018 |

OTHER PUBLICATIONS

First Office Action issued in connection with corresponding Chinese Patent Application No. 201811552516.1, dated May 25, 2021.
Search Report issued in connection with corresponding Chinese Patent Application No. 201811552516.1, dated May 17, 2021.

* cited by examiner

*Primary Examiner* — Richa Mishra
(74) *Attorney, Agent, or Firm* — Akerman LLP

(57) ABSTRACT

A method and device for training an acoustic model are provided. The method comprises determining a plurality of tasks for training an acoustic model, obtaining resource occupancies of nodes participating in the training of the acoustic model, and distributing the tasks to the nodes according to the resource occupancies of the nodes and complexities of the tasks. By using computational resources distributed at multiple nodes, tasks for training an acoustic model are performed in parallel in a distributed manner, so as to improve training efficiency.

5 Claims, 4 Drawing Sheets

METHOD AND DEVICE FOR TRAINING AN ACOUSTIC MODEL

CROSS-REFERENCE TO RELATED APPLICATION

This application claims priority to Chinese Patent Application No. 201811552516.1, filed on Dec. 18, 2018, which is hereby incorporated by reference in its entirety.

TECHNICAL FIELD

The present application relates to the field of computer technology, and in particular, to a method and device for training an acoustic model.

BACKGROUND

With the rapid development of various technologies in the information age, voice synthesis technology has gradually developed into the era of big data, and it has become much easier to acquire voice data. Compared with small corpus, more benefits may be brought to voice synthesis technology by applying large corpus. Specifically, by using large corpus, more comprehensive model context coverage may be achieved, more training samples and more voice rhythms may be provided.

In the current large corpus-based acoustic model training, the single-machine partial-task multi-processes approach is used for training. In the case of using large corpus, since the sharp increase in the number of the Hidden Markov Models (HMMs) leads to excessive memory occupancy, the single-machine partial-tasks approach can only be applied in a manner that a small number of processes run in parallel, or in single-process manner. This results in a long training time, so that a rapid training of models cannot be achieved. Therefore, there is a need for an improved method and device for training an acoustic model.

SUMMARY

A method and device for training an acoustic model are provided according to embodiments of the present application, so as to at least solve the above technical problems in the existing technology.

In a first aspect, a method for training an acoustic model is provided according to embodiments of the present application. The method can include determining a plurality of tasks for training an acoustic model, obtaining resource occupancies of nodes participating in the training of the acoustic model, and distributing the tasks to the nodes according to the resource occupancies of the nodes and complexities of the tasks.

In an implementation, the training an acoustic model includes a voice parameter extraction, and the determining a plurality of tasks for training an acoustic model includes dividing the voice parameter extraction into at least one task according to the complexities of the tasks for training the acoustic model and the number of the nodes participating in the training.

In an implementation, the training an acoustic model includes an HMM-based Speech Synthesis System (HTS) training, and the determining a plurality of tasks for training an acoustic model includes dividing the HTS training into at least one task according to the complexities of the tasks for training the acoustic model and the number of the nodes participating in the training.

In an implementation, the dividing the HTS training into at least one task includes dividing a decision tree-based model clustering into at least one task according to statuses of models generated in the HTS training and parameter characteristics of the generated models.

In an implementation, the distributing the tasks to the nodes according to the resource occupancies of the nodes and complexities of the tasks includes determining nodes participating in each of the tasks for training the acoustic model according to the resource occupancies of the nodes, and distributing the plurality of tasks for training the acoustic model to the nodes participating in each of the tasks for training the acoustic model.

In a second aspect, a device for training an acoustic model is provided according to embodiments of the present application. The device includes a dividing module configured to determine a plurality of tasks for training an acoustic model, an obtaining module configured to obtain resource occupancies of nodes participating in the training of the acoustic model, and a distribution module configured to distribute the tasks to the nodes according to the resource occupancies of the nodes and complexities of the tasks.

In an implementation, the training an acoustic model includes a voice parameter extraction, and the dividing module is further configured to divide the voice parameter extraction into at least one task according to the complexities of the tasks for training the acoustic model and the number of the nodes participating in the training.

In an implementation, the training an acoustic model includes an HMM-based Speech Synthesis System (HTS) training, and the dividing module is further configured to divide the HTS training into at least one task according to the complexities of the tasks for training the acoustic model and the number of the nodes participating in the training.

In an implementation, the dividing module is further configured to divide a decision tree-based model clustering into at least one task according to statuses of models generated in the HTS training and parameter characteristics of the generated models.

In an implementation, the distribution module is further configured to determine nodes participating in each of the tasks for training the acoustic model according to the resource occupancies of the nodes, and distribute the plurality of tasks for training the acoustic model to the nodes participating in each of the tasks for training the acoustic model.

In a third aspect, an apparatus for training an acoustic model is provided according to embodiments of the present application. The functions of the apparatus may be implemented by using hardware or by corresponding software executed by hardware. The hardware or software includes one or more modules corresponding to the functions described above.

In a possible design, the apparatus structurally includes a processor and a memory, wherein the memory is configured to store programs which support the device in executing the method for training an acoustic model described above, and the processor is configured to execute the programs stored in the memory. The device can further include a communication interface through which the device communicates with other devices or communication networks.

In a fourth aspect, a non-volatile computer readable storage medium for storing computer software instructions used for a distributed training device is provided. The computer readable storage medium can include programs involved in executing the method for training an acoustic model described above.

One of the above technical solutions has the following advantages or beneficial effects: tasks for training an acoustic model can be tested in batches by using nodes distributed on a plurality of devices to improve the training efficiency, it is suitable for an acoustic model training based on a large corpus with abundant corpus resources.

Another one of the above technical solutions has the following advantages or beneficial effects: the devices, where nodes are located, can be uniformly controlled and processed, such as task scheduling, reliability monitoring, load balancing and the like, so that the training is reasonably controlled.

The above summary is provided only for illustration and is not intended to be limiting in any way. In addition to the illustrative aspects, embodiments, and features described above, further aspects, embodiments, and features of the present application will be readily understood from the following detailed description with reference to the accompanying drawings.

BRIEF DESCRIPTION OF THE DRAWINGS

In the drawings, unless otherwise specified, identical or similar parts or elements are denoted by identical reference signs throughout several figures of the accompanying drawings. The drawings are not necessarily drawn to scale. It should be understood these drawings merely illustrate some embodiments of the present application and should not be construed as limiting the scope of the present application.

DETAILED DESCRIPTION OF THE EMBODIMENTS

Hereafter, only certain exemplary embodiments are briefly described. As can be appreciated by those skilled in the art, the described embodiments may be modified in different ways, without departing from the spirit or scope of the present application. Accordingly, the drawings and the description should be considered as illustrative in nature instead of being restrictive.

Figure 1:
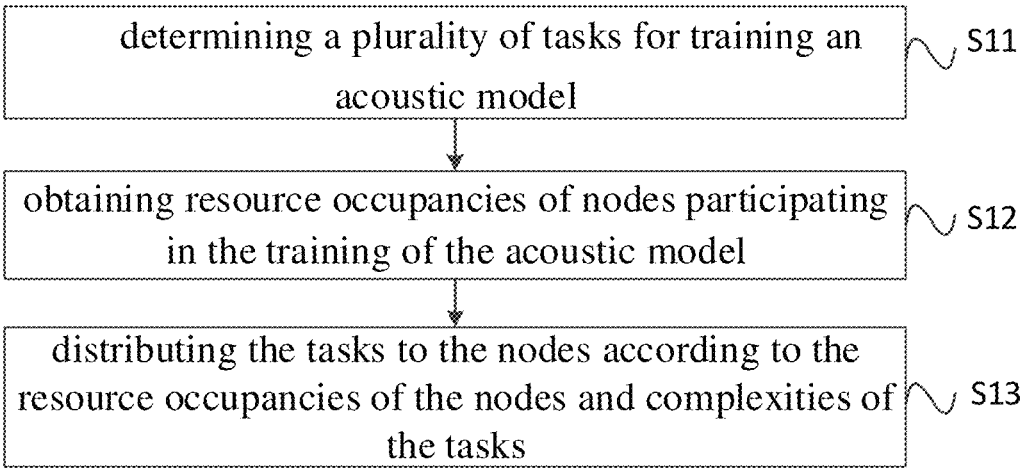
FIG. 1 is a flow chart showing a method for training an acoustic model according to an embodiment.

FIG. 1 is a flow chart showing a method for training an acoustic model according to an embodiment. As shown in FIG. 1, the method for training an acoustic model may include determining a plurality of tasks for training an acoustic model at S11, obtaining resource occupancies of nodes participating in the training of the acoustic model at S12, and distributing the tasks to the nodes according to the resource occupancies of the nodes and complexities of the tasks at 513.

When an acoustic model training is performed based on a large corpus, the training can be divided into a plurality of training parts, each of which can be divided into a plurality of training tasks, wherein the plurality of training tasks can be executed in parallel at a plurality of nodes.

In an embodiment, S11 can include obtaining complexities of the training tasks corresponding to different training parts of the acoustic model training, each of the training parts may correspond to one or more training tasks, wherein the complexity of training tasks may include at least one of the number of tasks and the context-related information of tasks.

Specifically, the complexity of training tasks may include various factors that affect execution efficiency, such as the number of tasks, context-related information. The context-related information may include voice information such as the speed of voice, tone, rhythm and rhyme of a training corpus. By applying a same training method, different training tasks may be obtained due to different speed of voices, tones, rhythms and rhymes of training corpuses.

By applying the above method, according to the embodiment of the present application, tasks for training an acoustic model can be performed in batches at a plurality of nodes distributed on a plurality of devices, thereby improving the training efficiency. It is suitable for an acoustic model training based on a large corpus with abundant corpus resources.

In an embodiment, S12 can include obtaining at least one of a Central Processing Unit (CPU) occupancy rate and a memory usage rate at each node participating in the training of the acoustic model.

In an embodiment, the number of nodes, the connection relationship between nodes may be changed, in order to form different distributed training networks. Different training tasks can be executed based on idle resources at different nodes.

For example, the number of nodes participating in the training can be increased or decreased according to the training tasks, so that the utilization efficiency of each node may be fully utilized.

As another example, a distributed network with different topological structures, such as a star type, a bus type, can be established by adjusting the connection relationship between nodes, thereby improving the interaction efficiency of instructions and data, and increasing the level of parallelization.

After determining the number of training parts, the number of training nodes can be determined according to the number of training tasks determined based on each of the training parts, wherein each node can be assigned with different number of training tasks. For example, each of the training tasks can be assigned to one corresponding node. Specifically, if it is required to perform 100 training tasks in batches, 100 nodes are needed. For another example, multiple training tasks can be assigned to one corresponding node. Specifically, if it is required to execute 100 training tasks in batches and to execute 5 training tasks at each node, 20 nodes are needed.

In an embodiment, tasks may be distributed in advance, and then the number of nodes may be determined as required. Specifically, when computing resources are limited or execution efficiency is low, the number of nodes may be increased as required, or, when computing resources are sufficient or execution efficiency is high, the number of nodes may be reduced as required. For example, assuming that there are 100 nodes participating in the training, if it is monitored that the computing resources are limited or the execution efficiency is low, the number of nodes can be expanded to 120, or, if the computing resources are sufficient or the execution efficiency is high, the number of nodes can be reduced to 80. The number of nodes can be increased or decreased dynamically and intelligently, or in a manual manner.

In an example, tasks can be distributed randomly to reduce communication and processing pressure of the monitoring module. In the random distribution status, the probability that a same task is repeatedly distributed to a same node is greatly reduced, so that the computing resources at respective nodes may be used in a relatively balanced manner.

Figure 2:
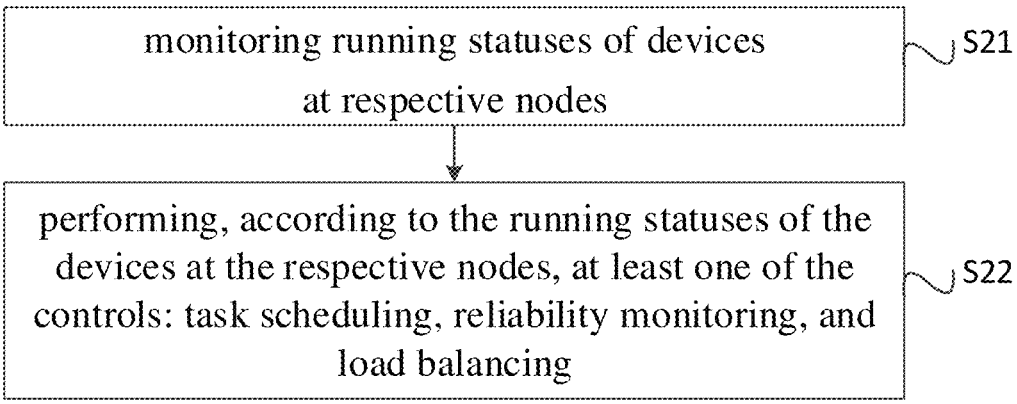
FIG. 2 is a flow chart showing a method for training an acoustic model according to an embodiment.

In an embodiment, as shown in FIG. 2, the method further includes monitoring running statuses of devices at respective nodes at S21, and performing, according to the running statuses of the devices at the respective nodes, at least one of the controls: task scheduling, reliability monitoring, and load balancing at S22.

In an example, according to the running status of the device at each note, it is possible to determine whether the device is reliable or not. For example, it is possible to determine whether the device often crashes, whether the running speed is too slow, or whether the training results are accurate. If the determined results of an acoustic model training are always exceptionally inaccurate, it may be considered whether the algorithm for training the acoustic model needs to be modified. If the running speed of the device at a certain node is particularly slow, it may be considered whether there is a failure with the hardware or software of the device.

In an example, if it is monitored that the load rates of the devices A1, A2, A3, and A4 at certain nodes are 10%, 0%, 80%, and 60%, respectively, a load balancing policy may be applied to distribute new training tasks to the device A1 with the load rate of 10% or the device A2 with the load rate of 0%.

Figure 3:
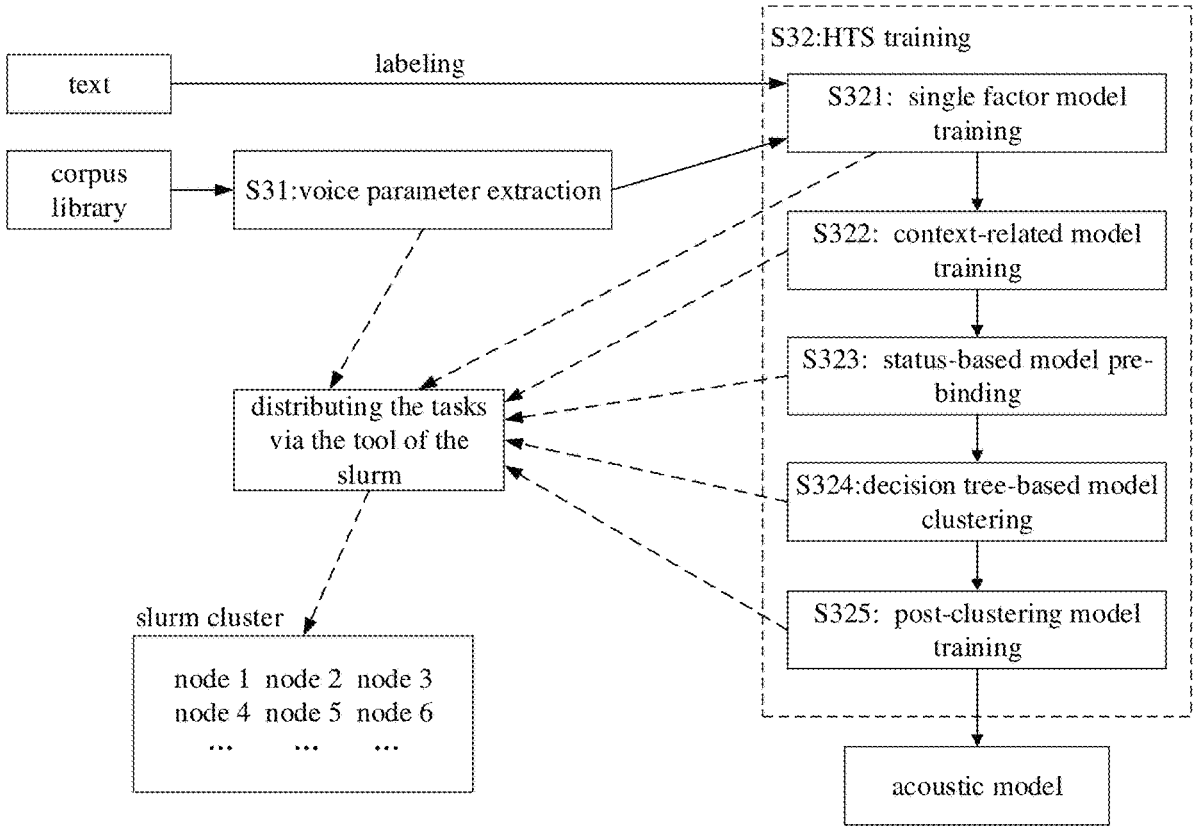
FIG. 3 is a flow chart showing a method for training an acoustic model according to an embodiment.

As shown in FIG. 3, in an example, the training an acoustic model may include a voice parameter extraction (S31) and an HMM-based Speech Synthesis System (HTS) training (S32), wherein the HTS training may further include the following S321 to S325.

Specifically, the method for training an acoustic model may include a voice parameter extraction at S31, that is, the extraction of voice parameters from a corpus library. In an example, the voice parameter extraction may be divided into a plurality of tasks based on the size of the Simple Linux Utility for Resource Management (slurm) cluster and the amount of audio data of training corpus. Then, the tasks are distributed to multiple nodes of the slurm cluster via the tool "srun" of the slurm. The tool "srun" can be used to distribute computing resources and start tasks for operation, so that it is possible to take full advantage of the CPU resources in the cluster, thereby speeding up the extraction of voice parameters, such as the fundamental frequency f0, the spectral parameter of Mel-Generalized Cepstral (mgc).

The method for training an acoustic model may further include an HTS training at S32. In an example, the HTS training may be divided into a single factor model training at S321, a context-related model training at S322, a status-based model pre-binding at S323, a decision tree-based model clustering at S324, and a post-clustering model training at S325. Each of S321 to S325 may be further subdivided into a plurality of tasks based on the size of the slurm cluster, the number of CPUs and memory status of the working machines, the size of the training data, and the like. The plurality of tasks are then distributed to multiple nodes in the cluster via the tool "srun" of the slurm, to take full advantage of the CPU resources in the cluster, and to reduce the requirements of the large corpus on the memory of a training machine, thereby accelerating the HTS training.

Specifically, an HTS training may include the single factor model training at S321. During the model training, the number of factors is equal to the number of generated HMM models. In an example, the single factor model training for these HMM models may be divided into a plurality of tasks based on the size of the slurm cluster, the number of CPUs and memory status of the working machines, the size of the training data, and the like. Then, the tasks are distributed to multiple nodes in the cluster via the tool "srun" of the slurm for parallel training.

An HTS training may further include the context-related model training at S322. Since each factor has a different context in the training corpus, a plurality of context-related HMM models may be generated. Therefore, the larger the corpus is, the more abundant the context information and the greater the number of context-related HMM models are. In an example, the context-related model training may be divided into a plurality of tasks based on the size of the slurm cluster, the number of CPUs and memory status of the working machines, the size of the training data, and the like. Then, the tasks are distributed to multiple nodes in the cluster via the tool "srun" of the slurm for parallel training.

An HTS training may further include the status-based model pre-binding at S323. The model generated by the context-related model training at S322 may be pre-bound according to the statuses of the models. In an example, the status-based model pre-binding may be divided into a plurality of tasks based on the size of the slurm cluster, the number of CPUs and memory status of the working machines, the size of the training data, and the like. Then, the tasks are distributed to multiple nodes in the cluster via the tool "srun" of the slurm for parallel training.

An HTS training may further include the decision tree-based model clustering at S324. The object of the decision tree-based model clustering is the HMM model generated by the context-related model training. During the decision tree-based model clustering, a large number of HMM models need to be loaded, so a large memory is needed. In addition, during the clustering, it is necessary to frequently calculate the log likelihood values of the decision tree nodes, which is computationally intensive and takes a long time. In an example, the decision tree-based model clustering may be divided into a plurality of tasks according to the statuses of models generated in the HTS training and parameter characteristics of the generated models, and based on the size of the slurm cluster, the number of CPUs and memory status of the working machines, the size of the training data, and the like. The tasks are then distributed to multiple nodes in the cluster via the tool "srun" of the slurm for clustering.

An HTS training may further include the post-clustering model training at S325. After completing the decision tree-based model clustering, the clustered models need to be trained to improve the accuracy of the models. In an example, the post-clustering model training may be divided into a plurality of tasks based on the size of the slurm cluster, the number of CPUs and memory status of the working machines, the size of the training data, and the like. Then, the tasks are distributed to multiple nodes in the cluster via the tool "srun" of the slurm for parallel training.

Figure 4:
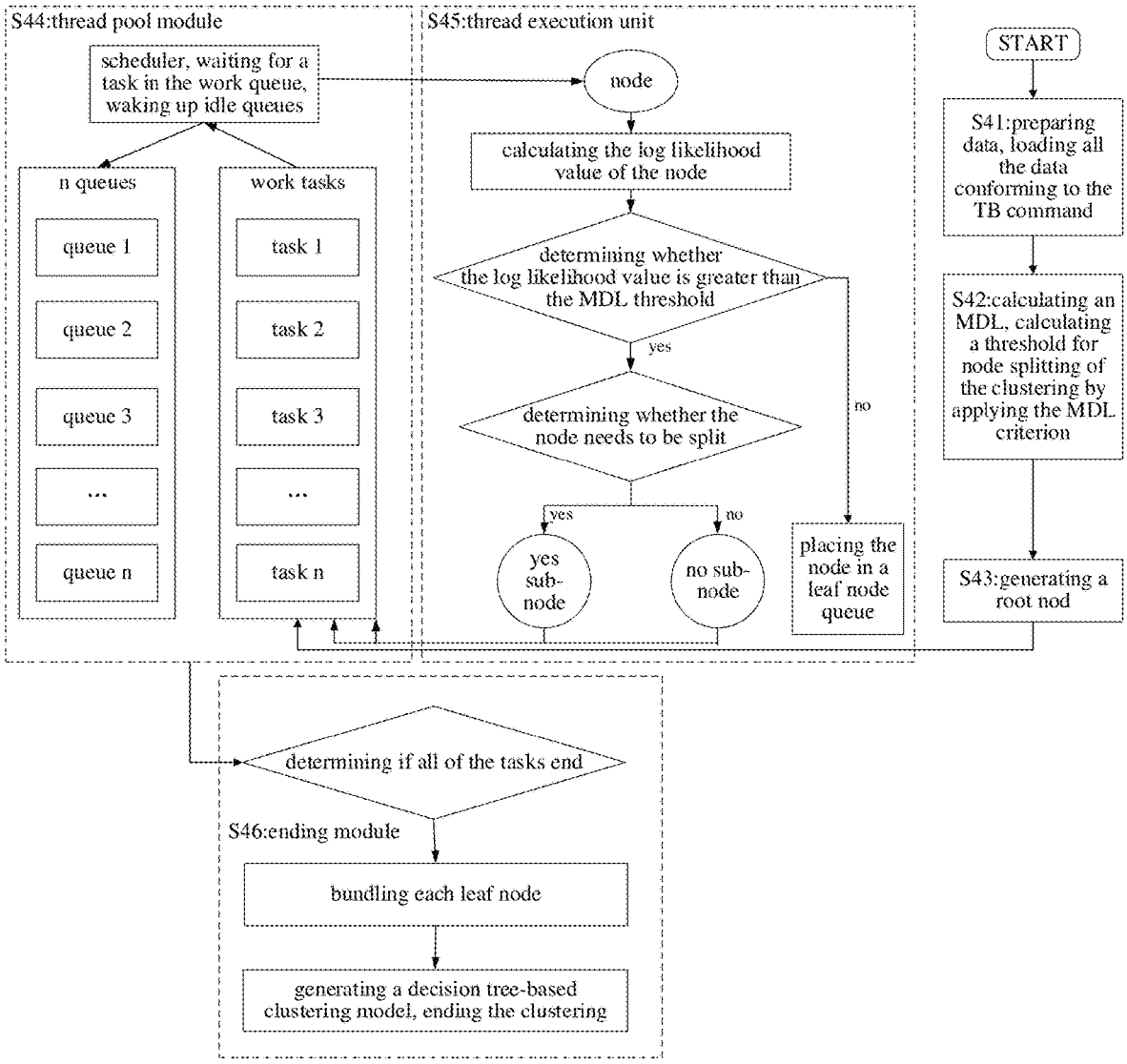
FIG. 4 is a flow chart showing a decision tree-based model clustering according to an embodiment.

FIG. 4 is a flow chart showing a decision tree-based model clustering.

As shown in FIG. 4, in an example, the decision tree-based model clustering includes preparing data, constructing data information to be clustered according to a TB command, and loading the data information into the decision tree-based model clustering at S41.

The decision tree-based model clustering further includes calculating a Minimum Description Length (MDL) threshold used in the clustering by applying the MDL criterion at S42. In an example, for one TB command, the threshold is calculated only once, and the same threshold is used in all subsequent node splitting determination.

The decision tree-based model clustering further includes generating a root node of the decision tree-based model clustering at S43. Here, the log likelihood value of the root node can be calculated.

The decision tree-based model clustering further includes pushing the generated root node to the thread pool module at S44. The thread pool module exists in each machine in a cluster and mainly includes a task queue, a scheduler, and a thread queue. The task queue is used to receive a work task that is externally pushed to the thread pool module, the scheduler assigns the task in the task queue head to the thread queue, and the thread queue executes a node splitting task for the decision tree-based model clustering through a thread execution unit.

In an example, during the HTS training, there are seven statuses of the HMM model. Each status corresponds to n streams of voice parameter characteristics. Accordingly, the decision tree-based model clustering may be divided into 7*n independent decision tree-based model clustering tasks. In addition, the decision tree-based model clustering task corresponding to a stream of single-status single-characteristics of a duration model should also be considered. Therefore, the entire decision tree-based model clustering can be divided into (7*n+1) independent decision tree-based model clustering tasks. These (7*n+1) tasks are then distributed to the thread queue for parallel execution by the scheduler, thereby improving execution efficiency.

The decision tree-based model clustering further includes executing a node splitting task for decision tree-based model clustering by means of a thread execution unit at S45. After determined a node to be split, the thread calculates the log likelihood value of the node first, then determines whether the log likelihood value is greater than the MDL threshold obtained at S42 and used in clustering. If the log likelihood value is less than the MDL threshold, the node is placed in a leaf node queue. If the value is greater than the MDL threshold, it is determined whether the node needs to be split. After the determination, the result is pushed to the thread pool module.

The decision tree-based model clustering further includes ending the task at S46. If it is determined that the task should be ended, the leaf nodes are bundled together, and a final decision tree-based clustering model is generated.

Figure 5:
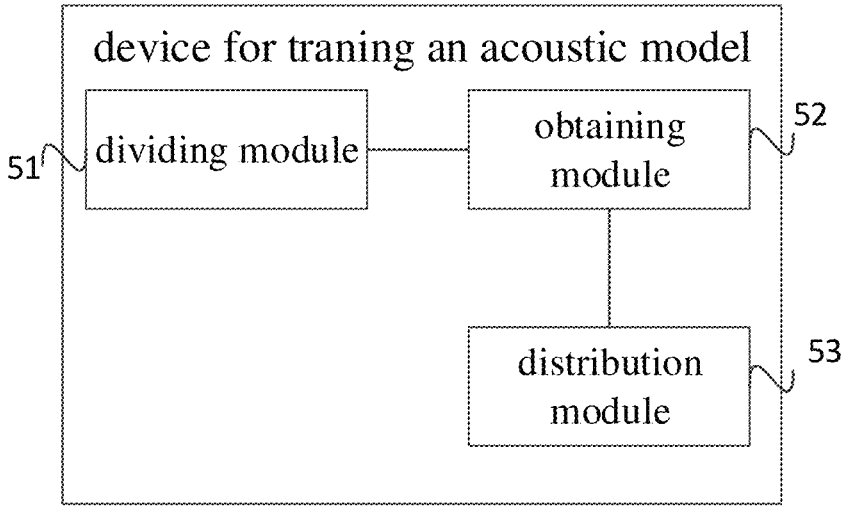
FIG. 5 is a block diagram showing a structure of device for training an acoustic model according to an embodiment.

FIG. 5 is a block diagram showing a structure of device for training an acoustic model according to an embodiment of the present application. As shown in FIG. 5, the device may include a dividing module 51 configured to determine a plurality of tasks for training an acoustic model, an obtaining module 52 configured to obtain resource occupancies of nodes participating in the training of the acoustic model, and a distribution module 53 configured to distribute the tasks to the nodes according to the resource occupancies of the nodes and complexities of the tasks.

In an embodiment, the complexity of tasks includes, but not limited to, at least one of the number of tasks and the context-related information of tasks.

In an embodiment, the training an acoustic model includes a voice parameter extraction, and the dividing module is further configured to divide the voice parameter extraction into at least one task according to the complexities of the tasks for training the acoustic model and the number of the nodes participating in the training.

In an embodiment, the training an acoustic model includes an HMM-based Speech Synthesis System (HTS) training, and the dividing module is further configured to divide the HTS training into at least one task according to the complexities of the tasks for training the acoustic model and the number of the nodes participating in the training.

In an embodiment, the dividing module is further configured to divide a decision tree-based model clustering into at least one task according to statuses of models generated in the HTS training and parameter characteristics of the generated models.

In an embodiment, the device further includes a monitoring module configured to monitor running statuses of devices at respective nodes, and to perform, according to the running statuses of the devices at the respective nodes, at least one of the controls on the nodes: task scheduling, reliability monitoring, and load balancing. For example, the monitoring module can obtain the running statuses at the nodes, such as CPU occupancy rate and memory usage, and can determine how to execute task scheduling according to the monitored running status.

Figure 6:
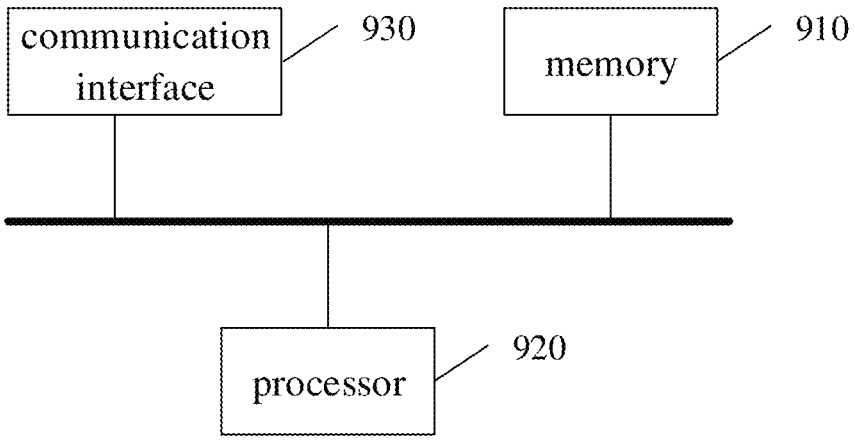
FIG. 6 is a block diagram showing a structure of device for training an acoustic model according to an embodiment.

FIG. 6 is a block diagram showing a structure of device for training an acoustic model according to an embodiment. As shown in FIG. 6, the device includes a memory 910 and a processor 920, wherein a computer program that can run on the processor 920 is stored in the memory 910. The processor 920 executes the computer program to implement the method for training an acoustic model according to the foregoing embodiments. The number of either the memory 910 or the processor 920 may be one or more.

The device may further include a communication interface 930 configured to communicate with an external device to perform data interaction and transmission.

The memory 910 may include a high-speed RAM memory, or may also include a non-volatile memory, such as at least one magnetic disk memory.

If the memory 910, the processor 920, and the communication interface 930 are implemented independently, the memory 910, the processor 920, and the communication interface 930 may be connected to each other via a bus so as to realize mutual communication. The bus may be an Industry Standard Architecture (ISA) bus, a Peripheral Component Interconnected (PCI) bus, an Extended Industry Standard Architecture (EISA) bus, or the like. The bus may be categorized into an address bus, a data bus, a control bus, and the like. For ease of illustration, only one bold line is shown in FIG. 6 to represent the bus, but it does not mean that there is only one bus or only one type of bus.

Optionally, in a specific implementation, if the memory 910, the processor 920, and the communication interface 930 are integrated on one chip, the memory 910, the processor 920, and the communication interface 930 can implement mutual communication through an internal interface.

According to an embodiment of the present application, it is provided a computer-readable storage medium having computer programs stored thereon. When executed by a processor, the programs implement the method described in any one of the above embodiments.

In the description of the specification, the description of the terms "one embodiment," "some embodiments," "an example," "a specific example," or "some examples" and the like means the specific features, structures, materials, or characteristics described in connection with the embodiment or example are included in at least one embodiment or example of the present disclosure. Furthermore, the specific features, structures, materials, or characteristics described can be combined in any suitable manner in any one or more of the embodiments or examples. In addition, different embodiments or examples described in this specification and features of different embodiments or examples can be incorporated and combined by those skilled in the art without mutual contradiction.

In addition, the terms "first" and "second" are used for descriptive purposes only and are not to be construed as indicating or implying relative importance or implicitly indicating the number of indicated technical features. Thus, features defining "first" and "second" can explicitly or implicitly include at least one of the features. In the description of the present disclosure, "a plurality of" means two or more, unless expressly limited otherwise.

Any process or method descriptions described in flowcharts or otherwise herein can be understood as representing modules, segments or portions of code that include one or more executable instructions for implementing the steps of a particular logic function or process. The scope of the preferred embodiments of the present disclosure includes additional embodiments where the functions are not performed in the order shown or discussed, including according to the functions involved, in substantially simultaneous or in reverse order, which should be understood by those skilled in the art to which the embodiment of the present disclosure belongs.

Logic and/or steps, which are represented in the flowcharts or otherwise described herein, for example, can be thought of as a sequencing listing of executable instructions for implementing logic functions, which can be embodied in any computer-readable medium, for use by or in connection with an instruction execution system, device, or apparatus (such as a computer-based system, a processor-included system, or other system that fetch instructions from an instruction execution system, device, or apparatus and execute the instructions). For the purposes of this specification, a "computer-readable medium" can be any device that can contain, store, communicate, propagate, or transport the program for use by or in connection with the instruction execution system, device, or apparatus. More specific examples (not a non-exhaustive list) of the computer-readable media include the following: electrical connections (electronic devices) having one or more wires, a portable computer disk cartridge (magnetic device), random access memory (RAM), read only memory (ROM), erasable programmable read only memory (EPROM or flash memory), optical fiber devices, and portable read only memory (CDROM). In addition, the computer-readable medium can even be paper or other suitable medium upon which the program can be printed, as it can be read, for example, by optical scanning of the paper or other medium, followed by editing, interpretation or, where appropriate, process otherwise to electronically obtain the program, which is then stored in a computer memory.

It should be understood various portions of the present disclosure can be implemented by hardware, software, firmware, or a combination thereof. In the above embodiments, multiple steps or methods can be implemented in software or firmware stored in memory and executed by a suitable instruction execution system. For example, if implemented in hardware, as in another embodiment, they can be implemented using any one or a combination of the following techniques well known in the art: discrete logic circuits having a logic gate circuit for implementing logic functions on data signals, application specific integrated circuits with suitable combinational logic gate circuits, programmable gate arrays (PGA), field programmable gate arrays (FPGAs), and the like.

Those skilled in the art can understand that all or some of the steps carried in the methods in the foregoing embodiments can be implemented by a program instructing relevant hardware. The program can be stored in a computer-readable storage medium, and when executed, one of the steps of the method embodiment or a combination thereof is included.

In addition, each of the functional units in the embodiments of the present disclosure can be integrated in one processing module, or each of the units can exist alone physically, or two or more units can be integrated in one module. The above-mentioned integrated module can be implemented in the form of hardware or in the form of software functional module. When the integrated module is implemented in the form of a software functional module and is sold or used as an independent product, the integrated module can also be stored in a computer-readable storage medium. The storage medium can be a read only memory, a magnetic disk, an optical disk, or the like.

The foregoing descriptions are merely specific embodiments of the present disclosure, but not intended to limit the protection scope of the present disclosure. Those skilled in the art can easily conceive of various changes or modifications within the technical scope disclosed herein, all these should be covered within the protection scope of the present disclosure. Therefore, the protection scope of the present disclosure should be subject to the protection scope of the claims.

What is claimed is:

1. A method for training an acoustic model, comprising:

determining a plurality of tasks for training an acoustic model;

obtaining resource occupancies of nodes participating in the training of the acoustic model; and distributing the tasks to the nodes according to the resource occupancies of the nodes and complexities of the tasks;

wherein the training an acoustic model comprises a voice parameter extraction and a Hidden Markov Model-based Speech Synthesis System (HTS) training; and the determining a plurality of tasks for training an acoustic model comprises:

dividing the voice parameter extraction into a plurality of first tasks and dividing the HTS training into a plurality of second tasks according to the complexities of the tasks for training the acoustic model and the number of the nodes participating in the training; wherein the complexities of the tasks comprises the number of the tasks and context-related information;

wherein the dividing the HTS training into the plurality of second tasks comprises: dividing a decision tree-based model clustering into a plurality of tasks according to statuses of models generated in the HTS training and parameter characteristics of the generated models.

2. The method for training an acoustic model according to claim 1, wherein the distributing the tasks to the nodes according to the resource occupancies of the nodes and complexities of the tasks comprises:

determining nodes participating in each of the tasks for training the acoustic model according to the resource occupancies of the nodes;

distributing the plurality of tasks for training the acoustic model to the nodes participating in each of the tasks for training the acoustic model.

3. A device for training an acoustic model, comprising:

one or more processors; and a memory for storing one or more programs;

wherein the one or more programs are executed by the one or more processors to enable the one or more processors to:

determine a plurality of tasks for training an acoustic model;

obtain resource occupancies of nodes participating in the training of the acoustic model; and distribute the tasks to the nodes according to the resource occupancies of the nodes and complexities of the tasks;

wherein the training an acoustic model comprises a voice parameter extraction and a Hidden Markov Model-based Speech Synthesis System (HTS) training; and the one or more programs are executed by the one or more processors to enable the one or more processors to:

divide the voice parameter extraction into a plurality of first tasks and dividing the HTS training into a plurality of second tasks according to the complexities of the tasks for training the acoustic model and the number of the nodes participating in the training; wherein the complexities of the tasks comprises the number of the tasks and context-related information;

wherein the one or more programs are executed by the one or more processors to enable the one or more processors to: divide a decision tree-based model clustering into a plurality of tasks according to statuses of models generated in the HTS training and parameter characteristics of the generated models.

4. The device for training an acoustic model according to claim 3, wherein the one or more programs are executed by the one or more processors to enable the one or more processors to:

determine nodes participating in each of the tasks for training the acoustic model according to the resource occupancies of the nodes;

distribute the plurality of tasks for training the acoustic model to the nodes participating in each of the tasks for training the acoustic model.

5. A non-transitory computer readable storage medium, in which a computer program is stored, wherein the computer program, when executed by a processor, causes the processor to implement operations of:

determining a plurality of tasks for training an acoustic model;

obtaining resource occupancies of nodes participating in the training of the acoustic model; and distributing the tasks to the nodes according to the resource occupancies of the nodes and complexities of the tasks;

wherein the training an acoustic model comprises a voice parameter extraction and a Hidden Markov Model-based Speech Synthesis System (HTS) training; and the determining a plurality of tasks for training an acoustic model comprises:

dividing the voice parameter extraction into a plurality of first tasks and dividing the HTS training into a plurality of second tasks according to the complexities of the tasks for training the acoustic model and the number of the nodes participating in the training; wherein the complexities of the tasks comprises the number of the tasks and context-related information;

wherein the dividing the HTS training into the plurality of second tasks comprises: dividing a decision tree-based model clustering into a plurality of tasks according to statuses of models generated in the HTS training and parameter characteristics of the generated models.

* * * * *